United States Patent [19]

Britton

[11] Patent Number: 4,705,331

[45] Date of Patent: Nov. 10, 1987

[54] SUBSEA CLAMPING APPARATUS

[75] Inventor: James N. Britton, Houston, Tex.

[73] Assignee: Wayne Graham & Associates International, Inc., Houston, Tex.

[21] Appl. No.: 690,760

[22] Filed: Jan. 11, 1985

[51] Int. Cl.[4] ..... H01R 33/00

[52] U.S. Cl. ..... 439/387; 24/463; 24/499; 24/502; 24/511; 24/DIG. 22; 204/197; 269/34; 269/254 R; 294/66.1; 294/110.1; 439/100; 439/266

[58] Field of Search ..... 339/13, 14 R; 204/197; 294/86.27, 19.3, 66.1, 110.1; 269/254 R, 34, 257, 271, 279, 282, 237, 280; 24/463, 489, 490, 495, 499, 500, 502, 511, 513, 514, DIG. 22, 507

[56] References Cited

U.S. PATENT DOCUMENTS

| | | | |
|---|---|---|---|
| 1,008,724 | 11/1911 | Lenderman | 294/110.1 |
| 1,033,531 | 7/1912 | Brown | 294/86.27 |
| 1,298,702 | 4/1919 | Harshaw | 294/86.27 |
| 1,336,815 | 4/1920 | Cairns | 294/86.27 |
| 2,852,830 | 9/1958 | Lloyd et al. | 24/514 X |
| 2,962,919 | 12/1960 | Grundmann et al. | 269/237 X |
| 3,408,034 | 10/1968 | Lau | 24/463 X |
| 3,553,094 | 1/1971 | Scott, Jr. et al. | |
| 3,556,314 | 1/1971 | Berger | 294/110.1 X |
| 3,741,517 | 6/1973 | Pognowski | |
| 3,803,012 | 4/1974 | Kurr | |
| 4,030,542 | 6/1977 | Poe et al. | 24/463 X |
| 4,097,084 | 6/1978 | Russell | 294/110.1 X |
| 4,309,263 | 1/1982 | Boyd | |
| 4,315,424 | 2/1982 | Jarman et al. | |
| 4,453,756 | 6/1984 | Haag | 294/86.27 X |
| 4,487,230 | 12/1984 | Anthony | 204/197 X |

FOREIGN PATENT DOCUMENTS

| | | | |
|---|---|---|---|
| 505866 | 1/1983 | Belgium | 294/110.1 |
| 1115204 | 10/1961 | Fed. Rep. of Germany | 24/463 |

*Primary Examiner*—Kenneth J. Dorner
*Assistant Examiner*—James R. Brittain
*Attorney, Agent, or Firm*—Darryl M. Springs

[57] ABSTRACT

A self-actuating clamp for attachment to a structural member in a subsea environment is disclosed. The clamp includes a housing having spaced side members, a transverse compression plate mounted between the members across the top of the housing and external accessory mounting surfaces. A pair of opposed, elongated jaw members have their upper portions disposed within the housing, the upper portions of which include upper ends adapted for pivotal mating engagement for permitting limited pivotal movement between the members, with the lower portions of the jaw members projecting below the housing and adapted for opposing clamping engagement with the subsea structural member. Force exerting means, which in one embodiment may comprise a pair of leaf spring assemblies, are provided to cooperate with the housing and jaw members to exert sufficient forces on the jaw members to clamp the jaw members to the exterior surface of the structural member. A trigger actuating assembly is provided for maintaining the jaw members in an open position while the clamp is properly positioned over the structural member, and releases the jaw members for permitting the force exerting means to close the jaw members into clamping engagment with the subsea structural member. Locking apparatus may also be provided for locking the jaw members in the clamped position engaging the subsea structural member.

41 Claims, 23 Drawing Figures

FIG. 3
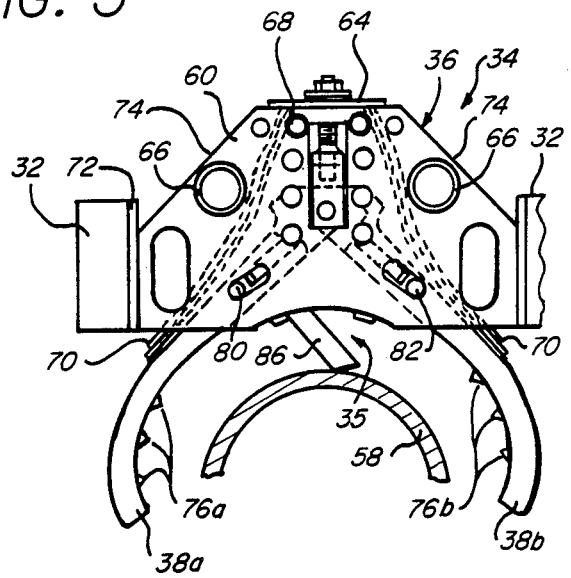
FIG. 4
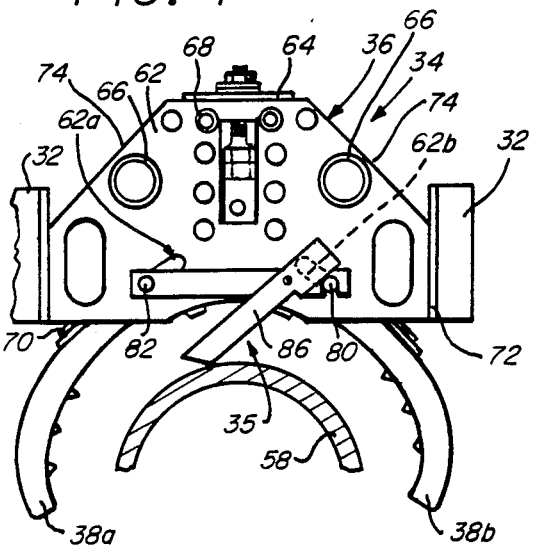
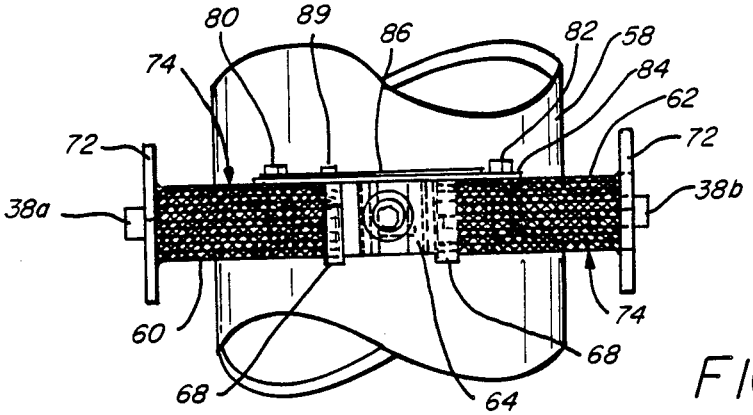
FIG. 5
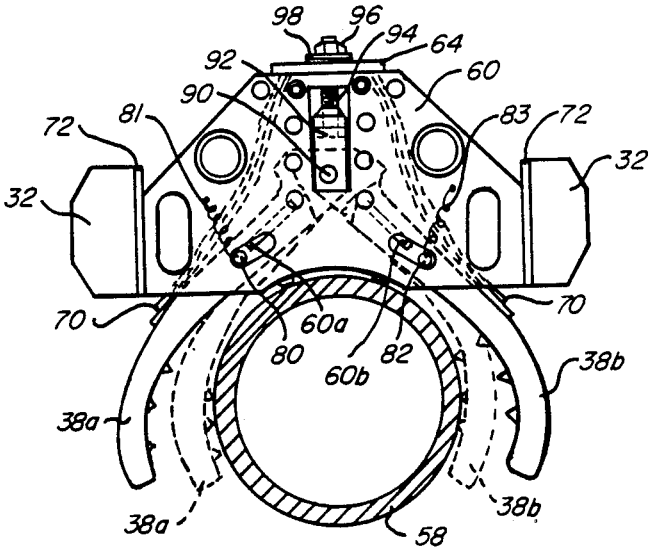
FIG. 6

SUBSEA CLAMPING APPARATUS

BACKGROUND OF THE INVENTION

This invention generally relates to a remotely operable clamp for attachment to a member disposed in a subsea environment, and more particularly relates to a remotely operable clamp utilizable with cathodic protection anodes or anode pairs to be attached to the submerged or subsea portion of a large metal structure, such as a drilling rig, production platform or pipeline. In addition, the clamp may be utilized in other subsea operations, such as salvage or pipeline repairs.

The offshore oil and gas industry utilizes many offshore subsea structures, such as offshore drilling platforms, offshore production platforms, well platforms, pipelines and other metal structures, all or the greatest portion of which are submerged in a subsea environment, and the majority of which are steel. All of these structures are provided with cathodic protection systems to safeguard the submerged metal surfaces of the structures in contact with the corrosive electrolytic subsea environment. The vast majority of the cathodic protection systems (probably better than 90%) are of the galvanic or sacrificial type, which means that electropositive metal alloys (mainly aluminum or zinc) that act as the anodes in the cathodic protection system are electromechanically attached to the subsea portions of the structures and are electrochemically sacrificed over long periods of time. The life of these systems is finite, and the anodes have to be replaced periodically, often in a time span of 10 to 15 years. Currently, replacement of the anodes on an off-shore structure have a number of problems associated therewith:

1. The installation costs of the replacement anodes are high because divers must be used to replace the anodes;

2. In deep waters the installation costs can become prohibitive due to the increased cost of the dive-time, including the extremely high cost of diver insurance to protect against the risks of injuries to the divers; and 3. Underwater welding techniques have not yet progressed to a point where an acceptable structural weld can be made on offshore structures in a subsea environment. Therefore most of the anode replacement systems must be clamped to the structure mechanically using fully-encircling clamps. On many large structures, where several hundred anodes must be replaced at one time, the diver time required to replace the anodes and use fully-encircling clamps drives the replacement cost to almost prohibitive levels.

The prior art in replacing anodes has been mainly confined to diver installed fully-encircling clamps. However, one major oil company has recently experimented with the use of remotely operated submersible vehicles (ROV's) by using a "ram set" explosively fired pin that secured a saddle to a subsea structural member of the structure to be protected. The pins actually penetrated the metal tubular member. The replacement anodes were attached by means of cables to the saddle and hung suspended by cable from the secured point on the structure. However, due to the fact that the full extent of potentially irreversible damage to the structural members has not yet been fully explored and defined, this technique is not generally considered satisfactory and has not gained acceptance.

The diver installed clamps that are presently in use for attaching anodes to the subsea portions of offshore structures suffer several serious disadvantages:

1. The fully-encircling devices such as "U"-bolts or semi-circular bolted clamps, require diver manual manipulation, positioning and attachment, and therefore are not convertible to diver-free installation by a remotely operated submersible vehicle or ROV;

2. The fully-encircling clamps are difficult to rig into position because they are bulky and hard to handle in a subsea environment, and hence are very time consuming to install; and 3. Since the fully-encircling clamps often have trouble penetrating any marine growth on the metal structural member, a set-screw must be utilized between the clamp and the metal structure to provide electrical continuity. Alternatively, a weld must be provided between the clamp and the metal struture. However, because of marine growth, the set-screw arrangement does not always provide good electrical continuity, and welding, which would be the most reliable form of providing electrical continuity, is frequently not possible because of the structure and the state-of-the-art of the technology, the marine growth and the location of the attaching point for the anodes.

BRIEF SUMMARY OF THE INVENTION

In accordance with this invention, a self-actuating clamp for attachment to a member disposed in a subsea environment is disclosed. The clamp includes a housing and jaw means including a pair of opposed, elongated jaw members cooperating with the housing and projecting below the housing for clamping engagement with the subsea member. Actuating means are provided for maintaining the jaw members in an open position, and when the clamp is properly positioned over the subsea member, releases the jaw members and permits the force exerting means to close the jaw members into clamping engagement with the subsea member. Force exerting means is also provided for cooperating with the jaw means and exerting clamping forces on each of the jaw members to engage the subsea member. Locking means cooperating with the force exerting means is also provided for exerting additional clamping forces on the jaw members engaging the subsea member and locking the jaw members.

The jaw means comprises a pair of opposed, elongated jaw members, the upper portions of which are disposed within the housing and with the upper ends of the jaw members adapted for pivotal mating engagement for permitting limited pivotal movement between the members, and allowing the lower portion of the jaw members to project below the housing. A pivot pin is transversely disposed through the upper mating ends of the pair of jaw members for supporting the jaw members in an opposed relationship and permitting pivotal movement therebetween.

An inverted U-shaped clevis is disposed over the mating upper ends of the jaw members for pivotally engaging and supporting the pivot pin. The force exerting means may comprise a pair of leaf spring assemblies disposed within the housing and positioned generally longitudinally adjacent the upper portion of each of the jaw members and having a lower end in engaging contact with the outer edge of each jaw member, the upper sections of the leaf spring assemblies engaging housing transverse structural members to provide a fulcrum for inducing compressive forces in the leaf spring assemblies that are translated through the lower end of the springs to the jaw members for biasing the jaw members inwardly toward a closed position. The actuating means may comprise a trigger assembly that cooperates with the jaw members for holding the jaw members in an open position, and in response to contact with the subsea member, to release the jaws and permit the force exerting means to close the jaw members around the subsea member.

In another embodiment, a clamp may be provided with remotely operable jacking means that can open and close the clamp from a remote location for engaging and disengaging the clamp from subsea structural members or debris in desired operations, such as in salvage and repair operations. In addition, such a remotely operable clamp may also have removable lower jaw sections that may have varying complementary configurations to serve special clamping, retrieval or salvage needs. The removable lower jaw sections may conveniently have a tongue and groove connection utilizing removable transverse retainer pins to join the sections to the upper portions of the jaw members.

In another embodiment, the clamp may be provided with a plurality of spaced spherical roller bearings disposed on the jaw members and the lower side of the housing to encircle and engage a tubular pipe member, while permitting rotational movement between the clamp and the pipe member. The spherical roller bearing configuration provides for self-centering of the tubular pipe member and may be utilized in vertical riser pipe alignment and installation.

The clamp apparatus according to this invention may be utilized in tandem to provide an anode installation assembly in which a pair of parallel, spaced anodes are mounted on a pair of spaced-apart, longitudinally aligned clamps that may be attached as one unit to a subsea structural member or to a subsea pipeline. In another tandem arrangment, a pair of spaced-apart, longitudinally aligned clamps mount a pair of elongated semi-circular cross-section sealing pads on the inside surfaces of the opposed longitudinally aligned jaw members for clamping over a pipeline leak to effect a temporary seal.

Also disclosed is a subsea transport apparatus for attachment to a remotely operated submersible vehicle (ROV) for engaging, carrying and installing the anode installation assembly or the pipeline repair assembly in the subsea environment.

A principal advantage of the presently disclosed clamping apparatus is that the apparatus may be utilized in anode installations by using a remotely operated submersible vehicle, thus significantly reducing the cost of anode installation.

Another advantage of the present clamp invention in anode installations is that the clamp is applied to the structural member under constant known torsion, hence the electrical continuity between the anode clamp and structural member is assured.

Still another advantage of the present clamp invention in anode installations is that the use of a predetermined spring actuating clamping force allows the clamps to be located on structural members over light marine growth without having to remove the growth prior to installation.

Yet another advantage of the present clamp invention is that it may be utilized in a wide range of subsea equipment and structural installations.

BRIEF DESCRIPTION OF THE DRAWINGS

In order that the manner in which the above-recited advantages and features of the invention are achieved can be understood in detail, a more particular description of the invention will now be made by reference to specific embodiments thereof which are illustrated in the accompanying drawings, which drawings form a part of this specification.

In the drawings:

FIG. 3 is a front view in elevation of a first embodiment of the clamping apparatus according to the present invention and shown positioned over a subsea tubular member.

FIG. 4 is a rear view in elevation of the clamping apparatus according to the present invention as shown in FIG. 1, and showing the details of the clamp actuating means.

FIG. 5 is a top or plan view of the clamping apparatus according to the present invention, shown positioned over a subsea tubular member.

FIG. 6 is a front view in elevation of the clamping apparatus according to the present invention showing the clamp jaw members in open and closed position about a subsea tubular member.

DETAILED DESCRIPTION OF THE INVENTION

Figures 1, 2, 7:
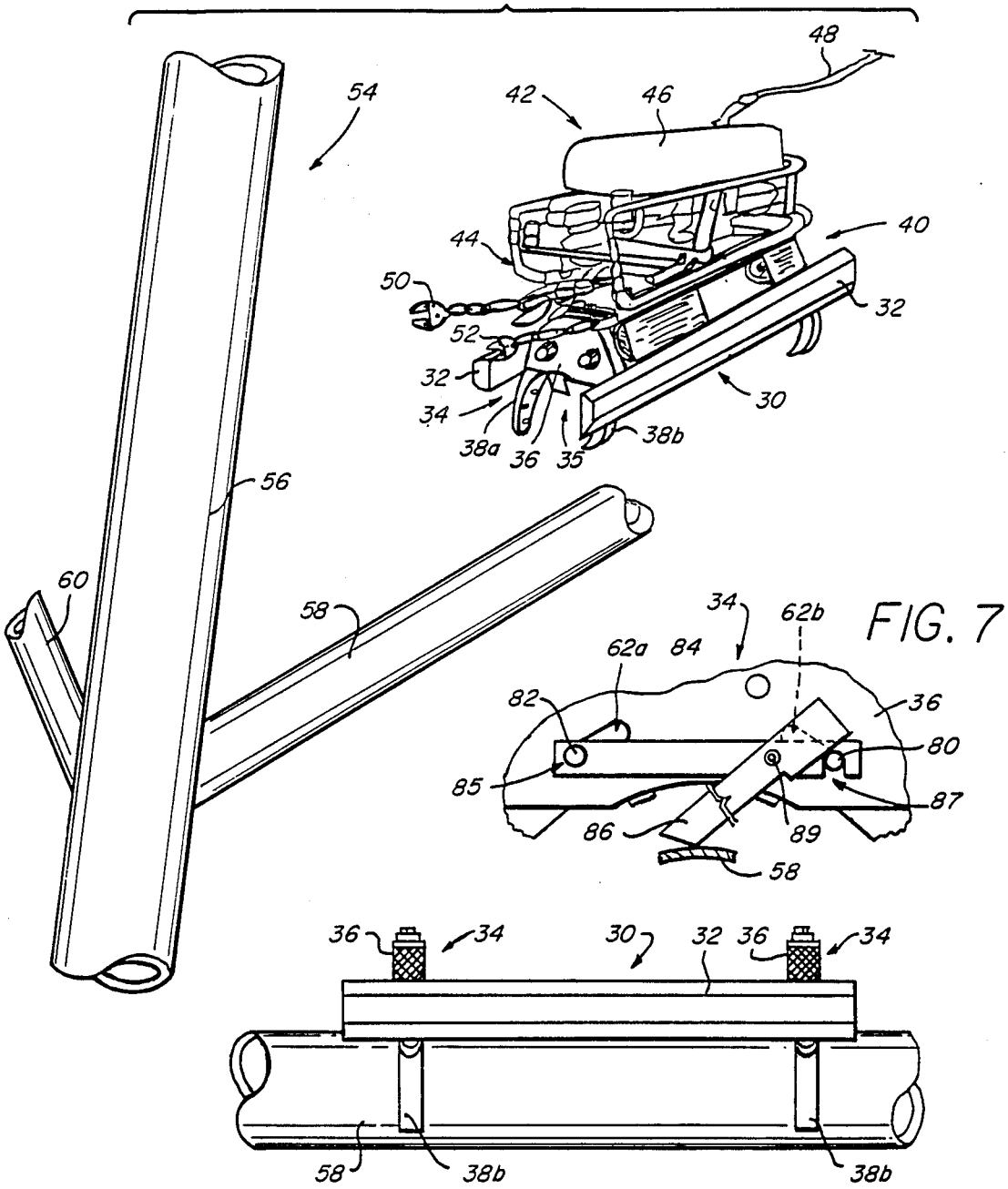
FIG. 1 is a perspective view of a portion of a submerged offshore structure to which an anode assembly utilizing the clamps of the present invention are being delivered by means of a remotely operated submersible vehicle.
FIG. 2 is a side view in elevation of an anode installation assembly utilizing a pair of clamps according to the present invention shown mounted on a section of a tubular pipe member of an offshore structure or on a section of a pipeline.
FIG. 7 is a partial detailed view of the clamping apparatus housing showing details of the actuating or trigger mechanism.

Referring now to FIGS. 1 and 2, a cathodic protection anode installation assembly 30 is shown being carried by a remotely operated submersible vehicle (ROV) 42 for mounting the anode assembly 30 on a crossbeam tubular member 58 of an offshore structure 54. The offshore structure 54 may typically be a drilling or production platform having a submerged portion that is in a subsea environment, and hence needs a cathodic protection system, and commonly may consist of a large diameter tubular member 56 comprising a leg of the structure and horizontal connecting tubular cross-members 58 and 60. The anode installation assembly consists of a pair of anodes 32 that are parallel spaced and attached to a pair of spaced longitudinally aligned clamping devices 34 that are self-actuating for permanent mechanical attachment to a subsea member such as tubular pipe member 58. Each clamping assembly 34 includes a housing 36 and clamping jaw means including projecting jaw members **38*a* and 38*b*. The jaw members 38*a* and 38*b* have a radiused configuration, generally matching the diameter of the subsea tubular pipe member 58, for permitting mating engagement of the jaw members 38*a* and 38*b* with the outer diameter of the pipe member 58**.

The anode assembly 30 may be carried by subsea transport apparatus 40 that is removably attached to the lower frame 44 of the ROV 42 as will be hereinafter described in greater detail. The ROV 42 typically comprises an open framing structure 44, fixed buoyancy module 46 of syntactic foam material for providing buoyancy for the ROV, a tethering and umbilical cable 48 for controlling the ROV, and other necessary motors and pumps for controlling the vehicle and its operational and manipulative functions.

The ROV 42 may also include manipulator arms 50 and 52 that can be remotely controlled and operated from a surface ship (not shown) by use of TV cameras (not shown). The manipulator arms permit the ROV 42 to perform such tasks as grasping and manipulation of tools, and tightening or releasing bolts such as by using an impact wrench, etc. The ROV 42 positions the anode installation assembly 30 by aligning the clamps 34 longitudinally with respect to the tubular member 58 and then lowering the ROV with the attached anode assembly 30 axially down upon the member 58 until the actuating means 35 is triggered, thus actuating the clamps 34 to mechanically clamp onto the outer surface of the tubular pipe member 58 as shown in FIG. 2.

Referring now to FIGS. 3–9, the construction and basic operation of a remotely operable clamp 34 will be described. As hereinabove defined, clamp 34 includes a housing member 36 and jaw means that includes a pair of projecting jaw members **38*a* and 38*b*. The housing 36 comprises a pair of generally wedge-shaped side plates or members 60 and 62 (see FIGS. 8 and 9) that are held in a spaced-apart relationship by transverse structural members 66 and 68 that are welded into place between the respective side members 60 and 62. The upper edges 74 of the side members 60 and 62 are angled downwardly and outwardly, preferably at about a 45° angle. The transverse tubular structural members 66 provide openings 66' through the housing while the smaller support structural members 68 provide transverse apertures 68' through the housing member 36. A compression plate 64 is mounted transversely across the top portion of the side members 60 and 62 to close the top of the housing 36 and provide rigid structural support. In addition, mounting plates 72 are mounted transversely across the ends of the side members 60 and 62 to provide vertical external accessory mounting surfaces or brackets. As above described, anodes 32 may be attached to the clamp mounting brackets 72** by suitable means such as welding.

Force exerting means which may comprise a pair of leaf spring assemblies 70 are disposed within the housing and cooperate with the housing 36 and the jaw members **38*a* and 38*b* to provide the clamping forces necessary for clamping jaw members 38*a* and 38*b* to the tubular member 58. The space between the upper edges 74 of side members 60 and 62 is closed by a perforated metal plate or a heavy wire mesh material 75 for providing additional structural rigidity for the housing, and also to provide safety in the event of spring breakage while the clamp 34 is manipulated prior to subsea use. The mesh or perforated plate 75 also permits visual inspection of the operating jaw members within the housing 36. Most importantly, the open or meshed surface 75 allows the cathodic protection current to flow into all internal areas of the clamp 34** to protect it from corrosion.

In the embodiment shown, the jaw members **38*a* and 38*b* have a generally radiused or "caliper" configuration for permitting mating engagement with a tubular member such as a structural cross-member or pipe 58. However, as will be hereinafter explained in additional detail, the configuration of jaw members 38*a* and 38*b*** may assume other shapes and sizes for engaging other structural members, or for grasping other materials disposed in a subsea environment, such as metal structural debris. In the embodiment shown, jaw member 38*a* carries a plurality of contact teeth 76*a* that are spaced longitudinally along the inner surface of the jaw member. Jaw member 38*b* carries a plurality of spaced contact teeth 76*b*. The contact teeth 76*a* and 76*b* may be made from either hardened steel or tungsten or titanium carbide for providing contact points that will mechanically penetrate any soft marine growth that has occurred on the surface of the member 58 and most forms of hard marine growth, such as barnacles, and will mechanically "bite" into the surface of the metal pipe member 58 for insuring a good mechanical and electrical connection to the pipe member 58. In addition, "teeth" in the form of conventional portions of pipe tong dies 78 are mounted on the lower curved portion of housing side members 60 and 62 to provide an anti-rotational slip or gripping surface.

The jaw members 38*a* and 38*b* comprise a pair of opposed elongated "caliper" shaped members, the upper portions of which are disposed within the housing 36 and between the pair of spaced side members 60 and 62 and located below the compression plate 64. The upper ends of the jaw members are adapted for pivotal mating engagement (as will be hereinafter further described in greater detail) for permitting limited pivotal movement between the jaw members 38*a* and 38*b*. As may be seen, the lower portions of the jaw members project below the housing side members 60 and 62. A pivot pin 90 is transversely disposed through apertures in the upper mating ends of the pair of jaw members 38*a* and 38*b* for supporting the jaw members in an opposed relationship and permitting pivotal movement between the members.

A shackle or inverted U-shaped clevis 92 cooperates with the mating upper ends of the jaw members 38*a* and 38*b* and engages and supports the ends of the pivot pin 90. Each of the housing side members 60 and 62 has disposed therein an elongated vertical slot 69 (see FIG. 8) along its vertical center-line, and the shoulders of the clevis 92 project into the registered slots 69 for guiding movement of the shackle 92 and pivot pin 90 in a vertical direction for purposes to be hereinafter further described. Attached to the top of the shackle or clevis 92 is an elongated threaded clevis rod 94 that projects vertically through an aperture in the compression plate 64. The threaded end of the rod 94 is engaged by a threaded nut 96 that has disposed between the nut and the compression plate a plurality of Belleville washers 98.

Figure 8:
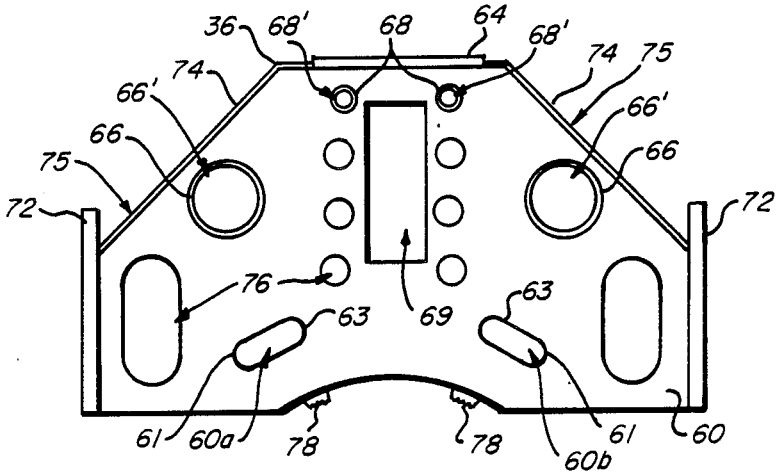
FIG. 8 is a front view in elevation of the housing of the clamping apparatus according to the present invention.
Figure 9:
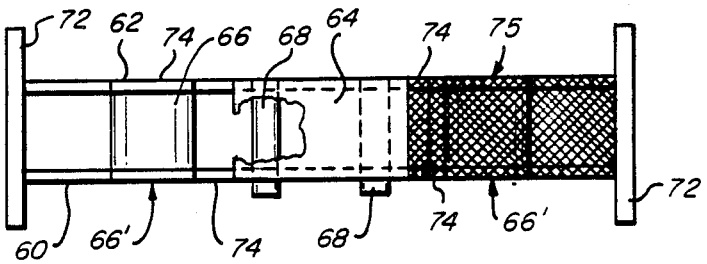
FIG. 9 is a top or plan view of the housing of the clamping apparatus according to the present invention.

The housing side members 60 and 62 also each include a pair of spaced, elongated, angled slots 60*a* and 60*b* and 62*a* and 62*b*, respectively. The pair of spaced slots 60*a* and 60*b*, disposed in side member 60, register with the pair of spaced slots 62*a* and 62*b*, disposed in the side member 62, for forming two pairs of registered, spaced-apart, elongated, angled slots 60*a*–62*a* and 60*b*–62*b*. Each pair of registered slots 60*a*–62*a* and 60*b*–62*b* slant inwardly and upwardly toward the vertical center line of the housing and toward the compression plate 64, and each have a lower stop end 61 and an upper edge that constitutes a slot camming surface 63 (FIG. 8). As hereinbefore generally described, actuating means 35 is provided for maintaining the jaw members 38*a* and 38*b* in an open position while the clamp is positioned over the subsea member 58, and to subsequently release the jaw members 38*a* and 38*b* to permit the force exerting means or spring assemblies 70 to close the jaw members into clamping engagement with the outer surface of the tubular member 58. For purposes to be hereinafter further explained, jaw member 38*a* carries a stop pin 80 disposed transversely therethrough and projecting into the pair of registered spaced-apart angled elongated slots 60*a*–60*b*, while jaw member 38*b* carries a stop pin 82 disposed transversely therethrough that projects into the pair of registered spaced-apart elongated angled slots 60*b*–62*b*. The stop pins 80 and 82 project beyond the housing side member 62 and have mounted thereon for cooperating therewith the actuating means 35 as will hereinafter be described in greater detail.

Actuating means 35 (see FIGS. 3, 4 and 7) comprises a trigger means that includes an elongated latch member 84 that has an aperture 85 in one end adapted for pivotal engagement with the end of the projecting stop pin 82. The other end of the latch member 84 has disposed therein a downwardly opening vertical slot 87 for engaging the projecting end of the other stop pin 80 when the jaw members 38*a* and 38*b* are in a desired "open" position. A trigger member 86 is pivotally attached to the latch member 84 by means of a pin 89 adjacent the latch member end carrying the slot 87 and is adapted for projecting downwardly below the housing 36. As the clamp 34 is lowered onto the tubular member 58, the projecting end of the trigger member 86 physically engages the outer surface of pipe 58, thus rotating the trigger member 86 upwardly. As the trigger member 86 is rotated upwardly, the other end of the trigger member engages the projecting stop pin 80 and levers the attached latch member 84 upwardly until the end carrying the slot 87 is disengaged from the stop pin 80. When the latch 84 disengages from stop pin 80, the compression force exerted by springs 70 force the jaw members 38*a* and 38*b* from an "open" position to a "closed" position in mating engagement with pipe 58. As a redundant feature, electrical continuity may be assured by welding electrical conductors 81 and 83 between the ends of stop pins 80 and 82, respectively, to a point of the housing 36 as shown in FIGS. 3 and 6.

Figure 10:
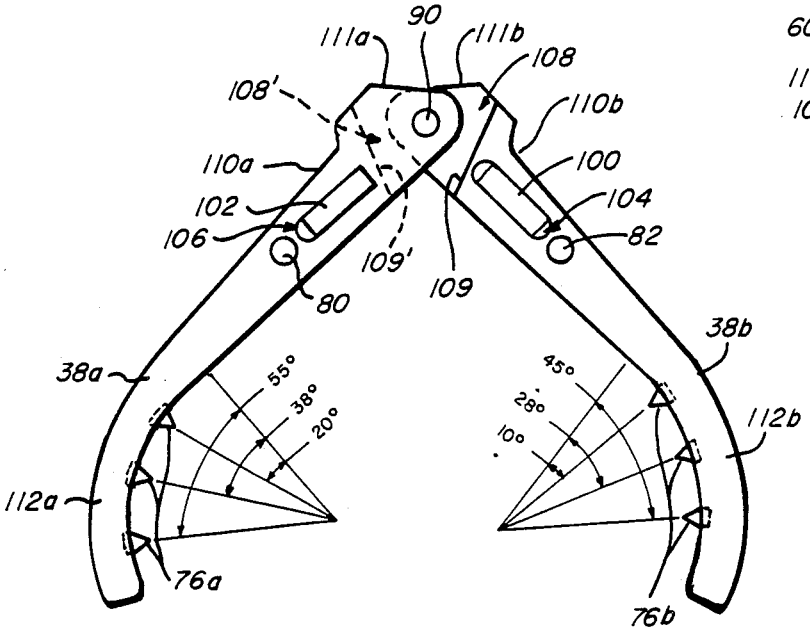
FIG. 10 is a side view in elevation of the pair of opposing jaw members shown in mating pivotal engagement with a transversely disposed pivot pin.
Figure 11:
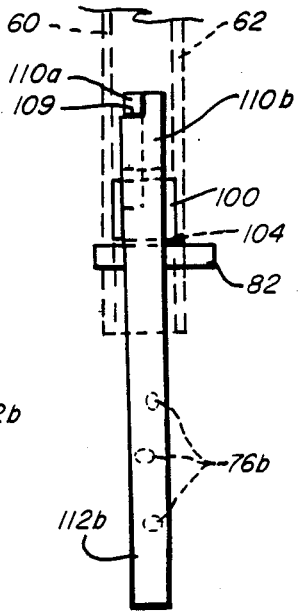
FIG. 11 is a side view in elevation of the pair of opposed jaw members of FIG. 10 shown in relation to the clamp housing.

Referring now to FIGS. 10 and 11, details of the jaw means of clamp 34 will be explained in greater detail. As previously described, the jaw means includes a pair of opposed, elongated jaw members 38*a* and 38*b* that cooperate with the housing 36 and project below the housing for clamping engagement with the tubular subsea member 58 (see FIG. 6). As previously described, each of the pair of opposed elongated jaw members 38*a* and 38*b* has an upper portion 110*a* and 110*b*, respectively, which are disposed within the housing 36 and between the pair of spaced side members 60 and 62 and below the compression plate 64. The upper ends 111*a* and 111*b* of the jaw members 38*a* and 38*b*, respectively, have mating cut away portions 108' and 108, respectively, for permitting mating engagement of the members about pivot pin 90 and providing a pair of opposed members that are adapted for pivotal movement therebetween in the same vertical plane. Cut away portions 108 and 108' have facing shoulders 109 and 109', respectively. Transverse slots 106 and 104 are disposed through the upper portions of jaw members 38*a* and 38*b*, respectively, for the mounting of spacer blocks 102 and 100, respectively. The spacer blocks 100 and 102 are welded to the jaw members 38*b* and 38*a*, respectively, and function as spacers and bearing guides between the inner surfaces of side members 60 and 62 for maintaining jaw members 38*a* and 38*b* in vertical alignment within the housing 36, as may be more particularly seen in FIG. 11.

The lower portions 112*a* and 112*b* of jaw members 38*a* and 38*b*, respectively, project below the housing side members 60 and 62 for engagement with the subsea tubular member 58, as hereinabove described. Also as previously described in this embodiment, the jaw members 38*a* and 38*b* have a radiused or "caliper" configuration for permitting mating engagement of the lower portions 112*a* and 112*b* with the tubular member 58. The inner surfaces of the radiused lower end portion 112*a* of jaw member 38*a* carries a plurality of spaced contact teeth 76*a* for "biting" engagement with the outer surface of the member 58. Similarly, the inner surface of the lower radiused portion 112*b* of jaw member 38*b* carries a plurality of spaced contact teeth 76*b*.

To enhance the "biting" engagement of the contact teeth 76*a* and 76*b*, and to prevent "skittering" or "skipping" action upon initial engagement with the outer surface of member 58, the sets of contact teeth 76*a* and 76*b* are not aligned vertically, but at least one of the contact teeth is offset horizontally from the vertical center line of the vertical orientation of other of the contact teeth 76*a* and 76*b*, as may be seen in FIG. 11. In addition, the radial spacing and location of the contact teeth 76*a* and 76*b* are slightly different as shown in FIG. 10. The contact teeth 76*a* are shown angularly spaced from a line normal to the jaw member 38*a* drawn through the locus of the jaw radius and spaced angularly respectively 20°, 38°, and 55°. However, the contact teeth 76*b* are angularly spaced from a line normal to the jaw member 38*b* drawn through the locus of the jaw radius and angularly spaced 10°, 28°, and 45°. As may be seen, the angular spacing between contact teeth 76*a* and 76*b* is identical, however, their position along the radiused inner surfaces of the lower portions 112*a* and 112*b* of jaw members 38*a* and 38*b*, respectively, is shifted by 10°. This "offsetting" of the angular spacing of the contact teeth helps prevent the "skittering" or "skipping" action when the jaw members initially engage the outer surface of tubular member 58. Of course, other angular spacing may be employed, however, the spacing disclosed has been found convenient and effective.

As has been previously described, a stop pin 80 is disposed transversely through jaw member 38*a* and a stop pin 82 is disposed transversely through the upper portion of jaw member 38*b*, and also project through one of the pair of registered, spaced-apart, elongated, angled slots 60*a*–62*a* and 60*b*–62*b*, respectively. The stop pins 80 and 82 project a greater distance through the side plate 62 for accommodating the actuating means 35 as herein previously described. The stop pins 80 and 82 are free to move within the pair of registered, spaced-apart, elongated, angled slots 60*a*–62*a* and 60*b*–62*b*, respectively (FIGS. 3 and 8). The stop pins 80 and 82 have their outer movement limited by the stop ends 61 of each of said respective pairs of angled slots 60*a*–62*a* and 60*b*–62*b* (FIG. 8), thus limiting the pivotal movement of jaw members 38*a* and 38*b* to a maximum open position. However, pivotal movement of the jaw members 38*a* and 38*b* to a minimum closed position is limited by the contact of jaw member shoulders 109 and 109'. The action of the stop pins 80 and 82 cooperating with the two pairs of registered, spaced-apart, elongated, angled slots 60*a*–62*b* and 60*b*–62*b* and the angled shoulders 109 and 109' cooperate to form a stop means for limiting pivotal movement between the opposing jaw members 38*a* and 38*b* within predetermined maximum open and minimum closed positions.

Figure 12:
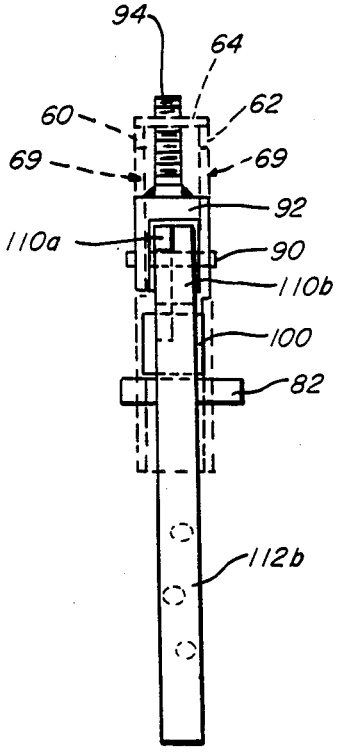
FIG. 12 is a side view in elevation of the pair of opposing jaw members, showing the position of the shackle means or inverted U-shaped clevis engaging the jaw members pivot pin and relationship to the clamp housing.

Referring now to FIG. 12, the shackle 92 comprises an inverted U-shaped clevis 92 disposed over the mating ends 110*a* and 110*b* of jaw members 38*a* and 38*b*, respectively. The lower depending ends of clevis 92 engage the projecting ends of pivot pin 90. As hereinabove described, the shoulders of the clevis 92 are aligned with and can move vertically in the slots 69 provided in side members 60 and 62. The clevis rod 94 is suitably attached to the top of the clevis 92, such as by welding or brazing, and projects through an aperture in the compression plate 64, as hereinabove previously described.

Figure 13:
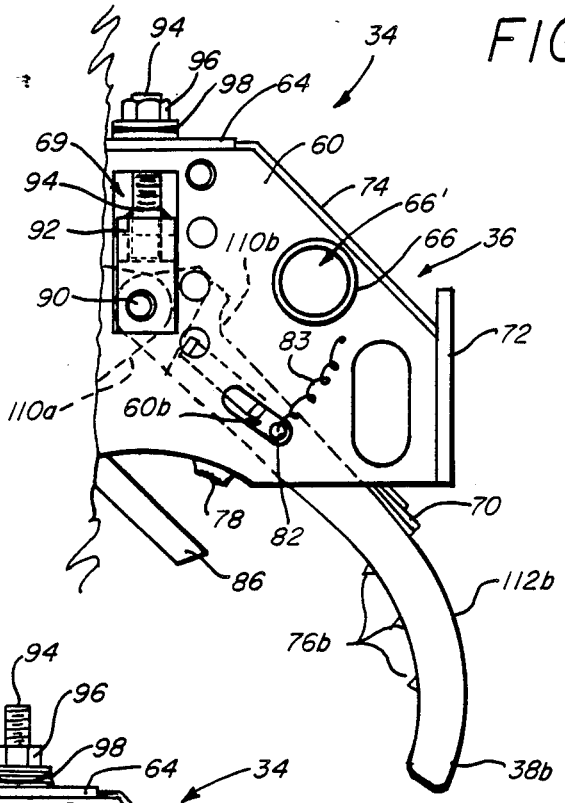
FIG. 13 is a partial front view in elevation of the clamping apparatus showing the jaw members in their fully "open" position in cooperation with the stop means.
Figure 14:
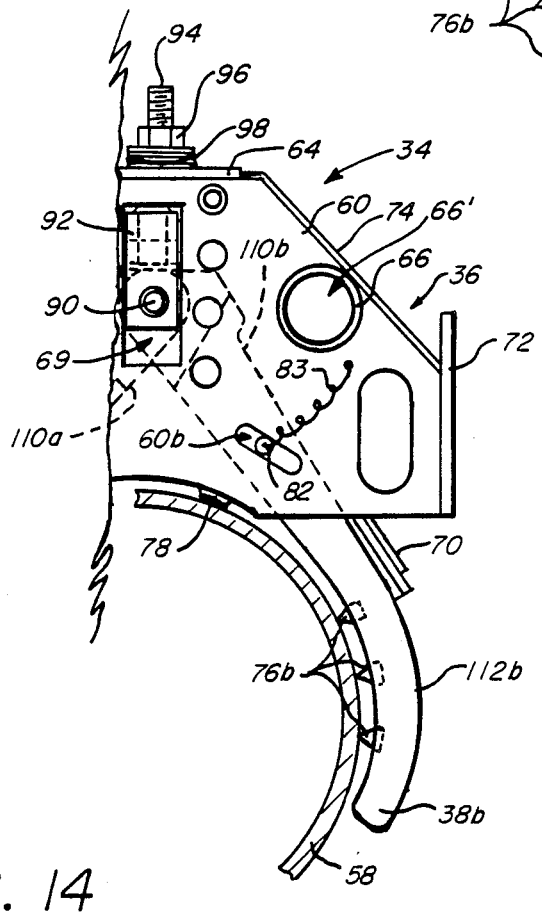
FIG. 14 is a partial front view in elevation of the clamping apparatus showing the jaw members in clamping engagement with a tubular structural member and the operation of the locking means.

Referring now to FIGS. 13 and 14, locking means for exerting additional clamping forces on the jaw members 38*a* and 38*b* engaging the subsea member 58 and locking the jaw members 38*a* and 38*b* with respect to each other and the housing 36 will be further explained. In FIG. 13, the clamp 34 is shown with the jaw members 38*a* and 38*b* set in their "open" position by means of the latch member 84 (not shown) as hereinabove described. While FIGS. 13 and 14 show only a portion of the entire clamp 34, for purposes of simplicity, it will be understood that the description herein made describes the entire clamp 34 and its operation as previously shown in FIGS. 3–6 and 8. The jaws 38*a* and 38*b* (see FIG. 6) may be moved to an "open" position by manually jacking the jaw members apart against the closing force exerted by the force actuating means or spring assemblies 70 until such time as the latch member slot 87 is permitted to engage projecting stop pin 80 (FIG. 7). Once the latch member 84 engages stop pin 80, the jaw members 38*a* and 38*b* will be maintained in their "open" position until released for clamping to the subsea member 58. In the "open" position, stop pins 80 and 82 will be in their substantially maximum lower position in registered angled slots 60*a*–62*a*, and 60*b*–62*b*, and may be engaging the lower stop ends 61 of the respective pairs of slots. In the "open" position, jaw members 38*a* and 38*b* are rotated outwardly about pivot pin 90, and pins 80 and 82 are cammed outwardly and downwardly in slots 60*a* and 60*b*, respectively, thus causing the clevis 92 to be moved downwardly to the lowest position within slots 69 of side members 60 and 62. The clevis rod 94 projects through an aperture in compression plate 64 and is loosely engaged by nut 96 that is spaced from compression plate 64 by means of the Belleville washers 98.

When the trigger member 86 has engaged tubular member 58 (see FIG. 7), and the latch member 84 has been disengaged from stop pin 80 as hereinabove described, the jaw members are released and the leaf spring assemblies 70 (shown in dotted lines in FIG. 14 for reasons to be hereinafter further explained) provide a compression force translated through the lower ends of the spring assemblies to the respective jaw members, 38*a* and 38*b*, for biasing the jaw members inwardly to a closed position to engage tubular member 58 (FIG. 14). Under the closing force of the springs 70, the jaw members 38*a* and 38*b* pivot inwardly toward each other, thus camming stop pins 80 and 82 inwardly and upwardly in their respective pairs of registered angled slots 60*a*–62*a* and 60*b*–62*b*. The inwardly and upwardly camming action of stop pins 80 and 82 causes the mating ends 110*s* and 110*b* of the jaw members 38*a* and 38*b*, respectively, to move upwardly, thus moving pivot pin 90 and clevis 92 vertically upwardly within the slots 69 in housing side members 60 and 62. As clevis 92 moves vertically within slot 69, the clevis rod 94 will be moved vertically upwardly through compression plate 64 and push the nut 96 upwardly out of contact with the Belleville washers 98.

However, after the jaw members 38*a* and 38*b* have been moved to their clamped position (FIG. 14), the manipulator arms 50 and 52 of the ROV 42 (see FIG. 1) can be used to rotate the nut 96 downwardly on the clevis rod 94 until the nut is again seated against the Belleville washers 98 and compression plate 64. Further downward rotation of nut 96 on clevis rod 94 will translate the rotating motion of the threaded nut into upward vertical movement of the rod 94. During such vertical movement the stop pins 80 and 82 will engage the upper camming surfaces 63 of the two pairs of angled slots 60*a*–62*a* and 60*b*–62*b*, respectively. Such camming action moves the stop pins 80 and 82 upwardly and inwardly until a point is reached where no further travel will occur. The force exerted by nut 96 on compression plate 64 in transmitted through pins 80 and 82, acting as lever fulcrum points, to apply an increased clamping force on the jaw members 38*a* and 38*b* against the tubular member 58.

The angle of the pair of registered slots 60*a*–62*a* and 60*b*–62*b* as measured from a horizontal line through the lower edges of housing 36 has been found to preferably be 30°. This angle provides a compromise between achieving maximum jaw member 38*a* and 38*b* pivotal travel and limiting the vertical travel of pin 90 and clevis 92 to reduce the vertical size of housing 36. Of course, any suitable angle between 1° and 89° could theoretically be used, but probably only an angular range of 30° to 60° would be practical in a working clamp. The cooperation of the nut 96 threadably engaging the clevis rod 94 acting against the Belleville washers 98 and compression plate 64, coupled with the camming action of stop pins 80 and 82 against the upper slot surfaces 63 of the respective pairs of registered angled slots 60*a*–62*a* and 62*a*–62*b* function as a locking means to lock the jaw members with respect to each other and the housing 36 in the clamped position. As may be seen, if the nut 96 is suitably torqued on the threaded rod 94, the clamping force of jaws 38*a* and 38*b* can be maintained even in the event of subsequent failure of one or both of the spring assemblies 70.

It will be readily understood from the foregoing description, that the clamp 34 could be constructed without the use of springs 70 acting as the force exerting means for clamping the jaw members 38*a* and 38*b* to the structural member 58. In all other aspects, construction of the clamps would be identical to that hereinabove described, except that no leaf springs 70 would be employed, as shown in FIG. 14, where springs 70 are shown in dotted lines. However, the actuating means 35 could be used to release the jaw members 38*a* and 38*b* as hereinabove described, and the jaw members, once released, would close to contact the tubular member 58 because of gravitational forces acting on the jaw members. The ROV positioning the clamps would have the capability to hold the clamps 34 in place and then tighten the nut 96 down on clevis rod 94 to transmit compressive forces against compression plate 64 to the jaw members 38*a* and 38*b* as clamping forces transmitted through the fulcrum points of pins 80 and 82 engaging upper slot surfaces 63 as hereinabove described. In this manner, the nut 96, clevis rod 94, Belleville washers 98, pins 80 and 82 and slot surfaces 63 cooperate to function both as force applying means and as locking means to apply clamping forces to member 58 and to lock the jaw 38*a* and 38*b* in their clamped positions.

The main components of clamp 34, such as side members 60 and 62, compression plate 64 and jaws 38*a* and 38*b* will preferably be constructed from normal grade A-36 steel, either cut, cast or forged. It has been found convenient to cut such major components from steel plate as opposed to more costly casting or forging. All of the leaf spring assembly 70 components and Belleville washers 98 are preferably constructed from spring steel. It will not be necessary to coat the clamp components to resist corrosion since the clamps 34 will be within the cathodic protection anode electrical field at all times, thus insuring corrosion protection.

In the "closed" or clamped position, electrical continuity will be completed and maintained between the various parts of the clamp, principally the jaw members 38*a* and 38*b* and the housing 36 to which the anodes 32 will be attached as shown in FIGS. 1–4. This is particularly true, since the clamps will be within the cathodic protection anode electrical field and completely protected from corrosion during the life of the attached anodes. However, as hereinabove previously described, in some cases it may be desirable to add a redundant electrical connection between the jaw members 38*a* and 38*b* and the housing 36. This may be accomplished by welding electrical conductors 81 and 83 between the ends of stop pins 80 and 82 at a point on the housing 36. (See FIGS. 3, 6, 13 and 14.)

Figure 15:
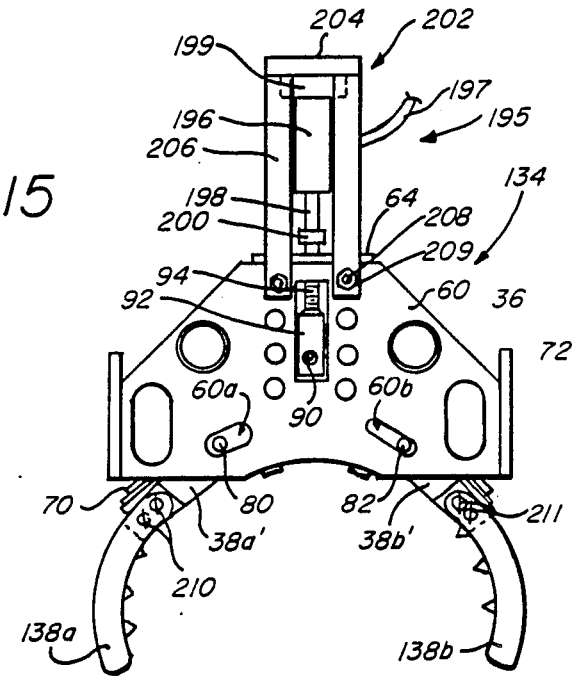
FIG. 15 is a front view in elevation of a second embodiment of the clamp apparatus showing a removable lower jaw section of each of the jaw members for attaching various configurations of opposing jaw members, and a remotely operated jacking means for opening and closing the jaw members for engaging and disengaging the clamp from a subsea structural member.
Figure 16:
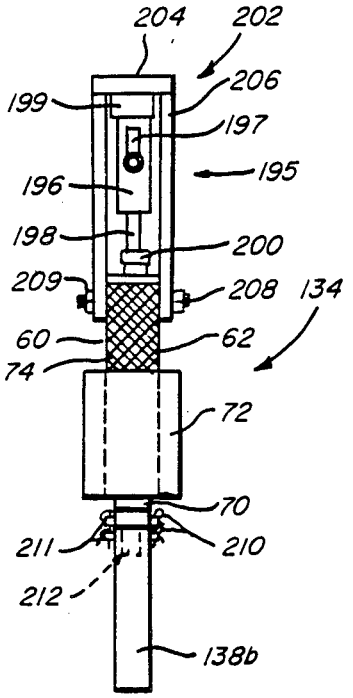
FIG. 16 is a side view in elevation of the second embodiment of the clamping apparatus as shown in FIG. 15.
Figure 18:
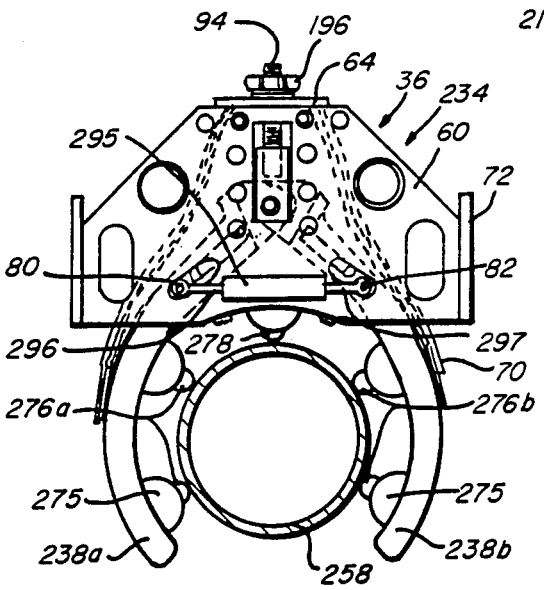
FIG. 18 discloses yet another embodiment of the clamping apparatus according to this invention which utilizes spherical roller bearings mounted on the jaw members and housing for contact with a tubular pipe member for permitting rotational movement of the clamping apparatus with respect to the tubular member.

Referring now to FIGS. 15 and 16, another embodiment of the subsea mounting clamp 134 is shown. Clamp 134 comprises a housing 36 generally identical to the housing shown for the earlier described clamp 34 but includes a modified actuating means 195 that can be remotely operated to manipulate the clamp jaw members to an "open" and "closed" position while the clamp is in its subsea environment. The clamp 134 comprises a housing 36 and a pair of lower jaw sections 138*a* and 138*b* that are another embodiment of the earlier described jaw members 38*a* and 38*b* as shown in the previous figures. Lower jaw sections 138*a* and 138*b* are detachably removable by means of a tongue and groove joint 212 and transverse pins 210 insertable through the lower jaw sections 138*a* and 138*b* and through to jaw member "stubs" 38*a*′ 38*b*′. The shortened jaw members 38*a*′ and 38*b*′ are opposed, elongated members, the upper portions of which are disposed within the housing 36 between the pair of spaced side members 60 and 62, and below the compression plate 64, just as for the previously described jaw members 38*a* and 38*b*. In addition, the upper ends of the jaw members 38*a*′ and 38*b*′ are adapted for pivotal mating engagement about a pivot pin 90 for permitting limited pivotal movement therebetween, identical to the action and operation of the earlier described jaw members 38*a* and 38*b*. A shackle or clevis 92, identical to the clevis previously described in the earlier embodiment, is disposed over the mating ends of the jaw member portions 38*a*′ and 38*b*′ and has an elongated clevis rod 94 fixed to the top of the clevis and projects vertically upward through an aperture in the housing compression plate 64, as previously described.

Bracket means 202 is attached to the housing 36 and supports a hydraulic cylinder 196 positioned vertically in axial alignment with the clevis rod 94. The hydraulic cylinder actuating rod 198 is coupled to the clevis rod 94 by means of a suitable fastening means such as a shoe or a threaded connector 200 that will mate with the end of a clevis rod 94. The support bracket means 202 comprises a bracket mounting plate 204 to which the base 199 of hydraulic cylinder 196 is fastened by means of any suitable fastening technique such as bolting or welding. The bracket mounting plate 204 is maintained in a spaced position above the clamp housing 36 by means of a plurality of spaced bracket arms 206, a pair of which are disposed on each side of housing 36 and fixed to base 204. A pair of bolts 208 are inserted through transverse apertures in the lower ends of support brackets 206 and through the transverse openings 68' through housing 36 and are secured by means of nuts 209. Of course, other suitable fastening means may be utilized, and the mounting bracket may either be permanently attached to the housing 36, or as in the embodiment herein disclosed, may be removably attachable such as to convert any previously described clamp 34 into a clamp that may be remotely opened and closed in the subsea environment.

The hydraulic cylinder 196 is controlled by means of hydraulic fluid supplied to the cylinder through hose 197. The hydraulic cylinder 196 may be any suitable hydraulic cylinder having a capability of exerting a downward force on the clevis rod 94 that is sufficient to easily overcome the force of the compression leaf springs 70. Accordingly, the hydraulic cylinder 196 can be actuated to extend the cylinder actuating rod 198 downwardly and forcing the clevis rod 94, the attached clevis 92 and pivot pin 90 downwardly to its lowest position, thereby forcing stop pins 80 and 82 into their lowest position in the pair of registered angled slots **60*a*–62*a* and 60*b*–62*b* as hereinabove described. In this condition, the jaw members 138*a* and 138*b*** will be in their maximum "open" position.

When it is desired to release jaw members **138*a* and 138*b*, the hydraulic pressure supplied to cylinder 196 can be released, permitting the force exerted by the compression spring 70 to close the jaw members 138*a* and 138*b* to their "closed" position. If desired, the cylinder 196 may be a double-acting cylinder, in which actuating rod 198 is retracted under pressure thus applying a locking force upwardly on the clevis rod 94 for locking the jaw members as hereinabove previously described. In another embodiment, if springs 70 are omitted as previously described, cylinder 196 may be a double-acting hydraulic cylinder and function as a force exerting means to close the jaws 138*a* and 138*b* around a pipe member. Of course, when it is desired to remove the clamp, the hydraulic pressure would be reversed in cylinder 196 and the actuating rod 198 again driven downwardly to force open jaw members 138*a* and 138*b*.**

Figures 17A, 17B:
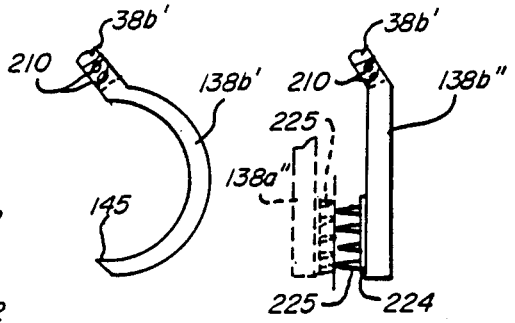
FIG. 17A is a front view in elevation of one embodiment of a specialized removable lower jaw section for special application in subsea salvage operations.
FIG. 17B is a front view in elevation of another embodiment of a removable lower jaw section that is designed for engaging debris for use in subsea salvage operations.

FIGS. 17A and 17B disclose a couple of additional embodiments of the removable lower jaw sections **138*b'* and 138*b''*. The jaw section 138*b'* (FIG. 17A) is adapted for tongue and groove attachment 212 to the jaw member stub 38*b'* as hereinabove described by means of retaining pins 210 and pin retaining means such as cotter pins or retaining rings 211 (see FIG. 16). In FIG. 17A, only the lower section 138*b'* is shown, although there would be an opposed mating lower jaw member section 138*a'* (not shown) for attachment to jaw member stub end 38*a'* (see FIG. 15) as hereinabove previously described. The jaw section 138*b'* shown is a large radiused jaw member the ends 145 of which would probably overlap with a corresponding end of the opposed mating jaw member 138*a'*** (not shown) for use as a grappling hook or "tongs" for attachment to large diameter tubular members or retrieving subsea debris.

The embodiment of the lower jaw section **138*b''* as shown in FIG. 17B, discloses a jaw section that is attachable to jaw member stub end 38*b'* as hereinabove described, and includes a horizontally disposed plate 224 attached to the lower end of the jaw section 138*b''*. The plate 224 carries a plurality of spaced elongated teeth or "spikes" 225 projecting therefrom. As shown in dotted lines, the opposing jaw member 138*a''* would carry mounted to its lower end thereof a plurality of projecting teeth or "spikes" 225', the spacing and pattern of which is intended to mesh or interlock with the pattern of projecting teeth or "spikes" 225 of the lower jaw section 138*b''* for the purpose of grappling or engaging various shaped pieces of debris during subsea salvage and recovery operations. Of course, many other variations of lower jaw sections 138*a* and 138*b*** may be utilized as needed or designed for a specific job or operation.

Another embodiment of the clamp 234 may be utilized in aligning sections of riser pipe from production heads on the sea floor to a production platform on a rig structure, where it is necessary to align pipe sections under water. The housing 36 of the clamp 234 is identical to the housing as previously described for the embodiment identified as 34 in previous figures, and includes side members 60 and 62 and a compression plate 64 mounted transversely between the side members as previously described. Accessory mounting plates 72 are attached to the ends of the housing 36 for attaching brackets or other structure necessary to align more than one clamp 234 in tandem for purposes of aligning adjacent sections of pipe (not shown). The jaw members **238*a* and 238*b* are a pair of opposed elongated jaw members having the identical mating structure of jaw members 38*a* and 38*b* as hereinabove described for the embodiment 34. However, is that the lower portions of jaw members 238*a* and 238*b* are longer and more radiused to encircle a larger portion of a desired pipe 258. Instead of contact teeth 76*a* and 76*b* as utilized with jaw members 38*a* and 38*b*, respectively, as hereinabove described, jaw members 238*a* and 238*b* each carry a plurality of industrial spherical roller bearings 276*a* and 276*b*, respectively, that have mounting bases 275 welded to the interior surfaces of the radiused jaw members 238*a* and 238*b*. In addition, the lower edges of the housing 36 mount a spherical roller bearing 278, replacing pipe tong teeth 78. The roller bearing 278 centers the tubular member or pipe 258 between the pairs of opposed roller bearing sets 276*a* and 276*b* for maintaining the tubular pipe member 258** in a desired centralized position.

A pair of hydraulic shock absorbers 295 are mounted horizontally outside the housing 36 adjacent side members 60 and 62 and pivotally engage stop pins 80 and 82 by means of actuating rods 296 and 297. The hydraulic shock absorbers 295 are provided to dampen the closing force applied to the jaw members **238*a* and 238*b* by springs 70 in order to prevent damage to the roller bearings 276*a*, 276*b* and 278. In addition, the hydraulic shock absorbers do not permit the full closing force of the leaf springs 70 to be applied to jaw members 238*a* and 238*b* and exerted against tubular member 258, but only allow sufficient force to maintain the clamp in centralized alignment about the tubular member 258 and permit rotation of the clamp 234 with respect to the tubular member 258. However, a locking nut 196 is provided as a replacement for the nut 96 as disclosed in previous embodiments, and threadably engages the clevis rod 94. The lock nut 196 can be tightened in order to exert additional clamping forces on jaw members 238***a* and 238*b*, and to lock them in a desired position such that they cannot be pulled or slipped off the engaged tubular member 258. However, after the installation operation has been completed, the lock nut 196 may be slacked off, thus freeing the clevis rod 94 and permitting it limited vertical movement, and the entire clamp assembly 234 may then be laterally slipped off tubular member 258 without having to physically drive "open" the opposing jaw members 238*a* and 238*b*.

Figure 19:
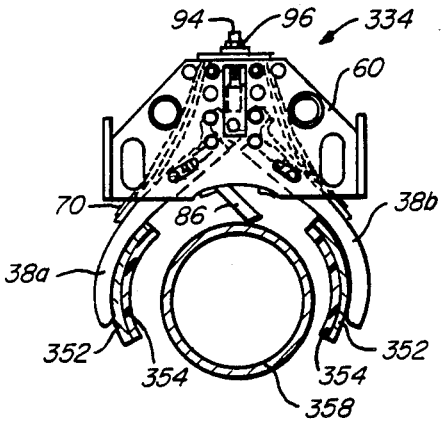
FIG. 19 is a front view in elevation of another embodiment of the clamping apparatus in which the jaw members are adapted for attachment to elongated semicircular cross-section sealing pads for clamping over pipeline leaks for affecting a temporary repair.
Figure 20:
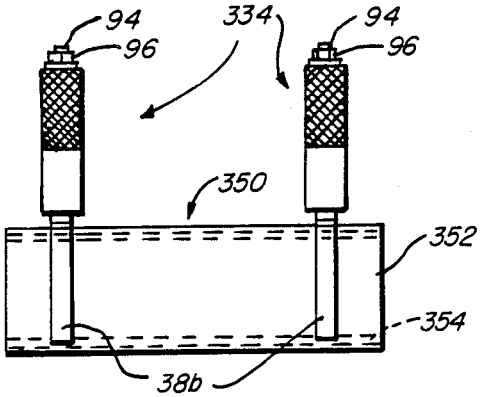
FIG. 20 is a side view in elevation of a pair of the clamps shown in FIG. 19 that are mounted in tandem and carrying a pair of leak sealing pads for use in temporarily repairing pipeline leaks.

Referring now to FIGS. 19 and 20, a temporary repair clamp 334 for pipelines is disclosed in which the previously disclosed embodiment 34 of the clamp, having projecting radiused jaw members 38*a* and 38*b* are utilized in a longitudinally aligned tandem pair similar to the tandem pairing of clamps 34 in the anode installation assembly 30 previously described. Clamps 334 are interconnected by means of a pair of parallel disposed, facing and radiused or semi-circular cross-section steel plates 352 that are welded to the interior radiused edges of the jaw members 38*a* and 38*b*. The inner surfaces of the steel plates 352 are covered with a hard rubber lining 354. The combination of the radiused steel plates 352 and the rubber lining 354 form a temporary pipeline sealing pad or sealing means 350 that can be clamped over a leak on a pipeline for temporarily sealing the leak until permanent repairs can be made. The sealing pressure applied to the seal-means 350 is supplied by the force exertinge means or spring means 70 which is sufficient to force the rubber pads 354 into sealing engagement with the surface of the pipe. The pipeline sealing assembly may be actuated by a trigger type mechanism 35 as previously disclosed, or may utilize an attached remote jacking means such as the hydraulic cylinder means 195 as previously described with regard to FIGS. 15 and 16. In all other respects, the operation of the clamps 334, as part of the pipeline sealing assembly, is identical to the operation of the clamp 34 as hereinabove described.

Figure 21:
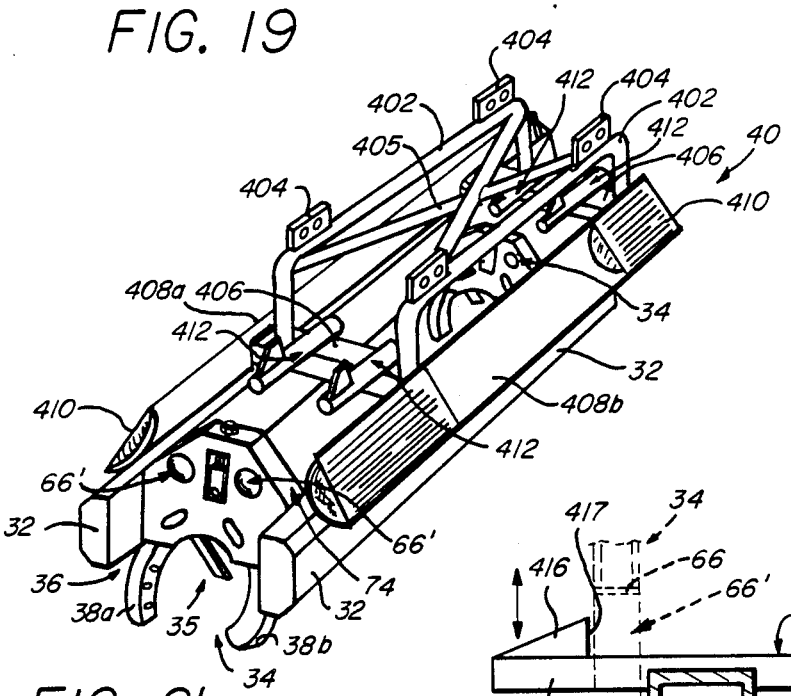
FIG. 21 is a perspective view of the subsea transport apparatus proposed for mounting on a remotely operated submersible vehicle that can be utilized to engage and transport an anode installation assembly or pipeline repair assembly.
Figure 22:
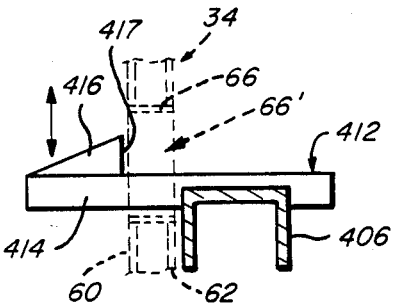
FIG. 22 is a detailed side view of one of the stabbing rods mounted on the subsea transport apparatus of FIG. 21 that are used to engage the clamps of the anode installation assembly or the pipeline repair assembly, shown in dotted lines.

FIGS. 21 and 22 show details of a proposed subsea transport apparatus 40 for attachment to an ROV 42 as shown generally in FIG. 1. The apparatus 40 includes a frame means including an open rectangular supporting frame 402 with cross-braces 405 and at least a pair of transverse structural members 406. A pair of spaced, parallel, semi-circular cross-section elongated steel channels 408*a* and 408*b* are mounted on the transverse members 406. A plurality of mounting brackets 404 are fixed to the upper frame 402 for suitably attaching the assembly 40 to the ROV 42. The radiused channels 408*a* and 408*b* are preferably mounted at a 45° angle to match the 45° angle of the sloping shoulders of housing 36 of the subsea clamp 34 as hereinabove described. Secured in each end of the semi-circular channels 408*a* and 408*b* are conventional buoyancy packs 410, similar to the buoyancy material of buoyancy module 46 previously described. The buoyancy modules 410 provide a selected neutral buoyancy to offset the weight of the package 40. However, the ROV 42 (FIG. 1) would also include additional "outrigger" buoyancy tanks (not shown for simplicity) that can be used to selectively overcome the weight of the anode installation assembly 30. The combination of channels 408*a* and 408*b* and the buoyancy members 410 form a buoyancy means for the apparatus 40.

Mounted on fore and aft transverse structural members 406 are pairs of stabbing rods 412 that project forwardly of the members 406 and are spaced and adapted for insertion into longitudinally aligned transverse apertures 66' provided in housing 36 as herein above previously described (FIG. 8). The pair of stabbing stabbing rods 412 mounted on a transverse member 406 each engage one of the pair of clamp members 34 of the anode assembly 30 shown in FIGS. 1 and 2. The details of the "stabbing" members 412 and their relationship to clamp housing 36 are shown in FIG. 22, and comprise a rod member 414 welded to the transverse structural member 406 and projecting forwardly of both the fore and aft structural members 406. A flange plate 416 is mounted at the tip of each of the stabbing rods 414, and has a triangular or "wedge" shape that slopes downwardly toward the forward end or "nose" of the stabbing rod 414. The flange plate 416 will permit self-centering of the ends of the stabbing rods 412 into the spaced apertures 66' (see FIG. 22) of clamps 34, and upon foward motin of the ROV 42, permit the stabbing rod 412 to slide freely throgh the lower portions of apertures 66', until the shoulder 417 moves past the side member 60 or 62 of the housing 36.

Once the stabbing member flange plates 416 are "through" the clamp transverse apertures 66', the ROV 42 ballast tanks (not shown), previously flooded with water to provide neutral buoyancy, now admit compressed air to drive out the water and provide positive buoyancy to overcome the weight of the anode installation assembly 30. As compressed air fills the tanks, the ROV 42 rises, as does shoulder 417 of the wedge plate 416, and the housing side member 60 or 62 will engage the retaining plate shoulder 417 in order to prevent disengagement of the clamps 34 and the anode installation assembly 30. Once the auxiliary buoyancy tanks (not shown) have achieved a positive buoyancy sufficient to compensate for the weight of the payload, the ROV 42, now neutrally buoyant, can be maneuvered by using its thrusters to transport the anode assembly or other payload to a desired location. If the payload is the anode assembly 30 (FIGS. 1 and 2), the ROV 42 will maneuver the assembly into clamping engagement with the desired tubular member 58. Once the clamps 34 are actuated to clamp onto pipe 58, the ROV 42 would flood its ballast tanks again with seawater until the ROV achieves a neutral byouancy, permitting the ROV to settle down on the anode installation 30 and disengage retaining plate shoulders 417 from housing side member 60 or 62. The stabbing rods 412 can then be withdrawn from apertures 66' by reverse maneuvering of the ROV 42. The ROV 42 can now be maneuvered to pick up another anode assembly 30 for delivery to a desired location as hereinabove described.

Numerous variations and modifications may be made in the structures herein described without departing from the present invention. Accordingly, it should be clearly understood that the form of the invention herein described in the figures of the accompanying drawings are illustrative only and are not intended to limit the scope of the invention.

I claim:

1. A self-actuating clamp for attachment to a member disposed in subsea environment, comprising a housing, including a pair of spaced side members, each of said side members having disposed therein a pair of horizontally spaced angled slots, the pair of horizontally spaced slots disposed in one side member registering with the pair of horizontally spaced slots disposed in the other of said side members for forming two pairs of registered horizontally spaced-apart elongated angled slots, each of said pair of registered slots slanting inwardly and upwardly toward the top edges of said side members, a compression plate mounted transversely to the to edges of said pair of side members and having an aperture disposed centrally therethrough, and at least one external accessary mounting plate attached transversely to said pair of side members, a pair of opposed elongated jaw members the upper portions of which are disposed within said housing and between said pair of spaced side members and below said compression plate, the upper ends of said jaw members adapted for pivotal mating engagement for permitting limited pivotal movement therebetween, the lower portions of said jaw members projecting below said housing side members and having mating configurations adapted for clamping engagement with the subsea member, a pivot pin transversely disposed through said upper mating ends of said pair of jaw members for supporting said jaw members in an opposed relationship and permitting pivotal movement therebetween, a pair of stop pins one of which is disposed transversely through each of said jaw members and projects through one of said pair of registered horizontally spaced-apart elongated angled slots and each of said side members, an inverted U-shaped clevis disposed over said mating ends of the pair of jaw members and engaging the opposite ends of said pivot pin, an elongated clevis rod fixed to said inverted U-shaped clevis and projecting vertically through said aperture in said compression plate, trigger means, comprising an elongated latch member having a transverse aperture in one end adapted for pivotal engagement with the end of one of said jaw stop pins projecting beyond said one housing side member, the other end of said latch member having a downwardly opening vertical slot disposed therein for engaging the end of the other one of said pins projecting beyond said one housing side member when said jaw members are in an open position, and a trigger member attached to said latch member and projecting downwardly below said housing for physically contacting the subsea member when the subsea member is properly positioned between said spaced-apart jaw members, said trigger member engaging the subsea member for exerting an upward force on said latch member for pivoting said latch member slotted end upwardly out of engagement with said other jaw stop pin, and force exerting means disposed within said housing and carried thereby and engaging each of said pair of jaws for exerting sufficient closing force on each of said jaw members for clamping said jaw members into engagement with said subsea member when said trigger latch member has been disengaged from said jaw stop pins.

2. The clamp as described in claim 1, where each of said housing side members has an elongated slot disposed therein along its vertical center line, and wherein the shoulders of said U-shaped clevis project into said slots for guiding movement of said clevis and pivot pin in a vertical direction.

3. The claim as described in claim 1, wherein said force exerting means comprises spring means disposed within said housing between said side members and cooperating with said jaws for exerting clamping forces thereagainst to close said jaw members.

4. The clamp as described in claim 3, wherein said spring means comprises transverse structural means disposed between said housing side members and adjacent said upper ends of said mating jaw members, and a pair of leaf spring assemblies disposed between said housing side members, each of said leaf spring assemblies positioned generally longitudinally adjacent said upper portion of one of said jaw members and having a lower end in engaging contact with the outer edge thereof, the upper portion of said leaf spring assemblies engaging said housing transverse structural means for inducing compressive forces in each of said leaf spring assemblies translated through said lower ends thereof to said jaw members for biasing said jaw members inwardly to a clamped position.

5. The clamp as described in claim 1, further including locking means mounted on said housing compression plate and cooperating with said projecting clevis rod for applying a lifting force on said clevis rod and the upper ends of said mating jaw members and exerting additional clamping forces on said jaw members engaging the subsea member and for locking said jaw members with respect thereto.

6. The clamp as described in claim 5, wherein said locking means comprises lifting means cooperating with said clevis rod and said housing compression plate for vertically lifting said clevis and supported pivot pin and mating ends of said jaw members toward said compression plate and exerting a force therebetween, said jaw member stop pins in response to said lifting means engaging the upper sides of each of said pair of registered angled slots for camming said stop pins upwardly and inwardly until a stopping point is reached, said stopping points acting as lever fulcrum points for said stop pins to transfer said lifting means force to said jaw members, and means for locking said jaw members with respect to said subsea member.

7. The clamp as described in claim 6, wherein said clevis rod is threaded, and wherein said lifting means comprises a nut threadably engaging the threaded end of said clevis rod projecting above said compression plate for translating rotating motion of said nut into vertical lifting movement of said rod and applying a lifting force between said rod and said compression plate.

8. The clamp as described in claim 7, wherein said means for locking said jaw members comprises said nut cooperating with said threaded clevis rod, a plurality of Belleville washers disposed between said nut and said compression plate, and the cooperation of said jaw member stop pins engaging said upper sides of said pair of registered angled slots for preventing movement of said jaw members with respect to each other and with respect to said housing.

9. The clamp as described in claim 5, wherein said actuating means and locking means comprise a hydraulic cylinder positioned vertically in axial alignment with said clevis rod extending above said compression plate, connecting means for connecting the end of the actuating rod of said hydraulic cylinder and the end of said clevis rod for transmitting upward force applied by said actuating rod to said clevis rod and to said jaw members for closing said jaw members into a clamped position engaging the subsea member, bracket means for mounting said hydraulic cylinder on said compression plate for supporting said hydraulic cylinder in a vertical position above said housing, said hydraulic cylinder cooperating with said clevis rod and said housing compression plate for applying a vertical lifting force to said clevis and supported pivot pin and mating ends of said jaw members toward said compression plate and exerting forces therebetween, said jaw member stop pins engaging the upper sides of each of said pair of registered angled slots for camming said stop pins upwardly and inwardly until a stopping point is reached, said stopping points acting as lever fulcrum points to transfer said force to said jaw members, said jaw member stop pins cooperatively engaging said upper sides of said pair of registered angled slots at said stopping points for preventing movement of said jaw members with respect to each other and with respect to said housing.

10. The clamp as described in claim 1, further including a flexible metal cable fixed to one of the projecting ends of each of said jaw member stop pins and one of said housing side plates to insure electrical continuity therebetween.

11. The clamp as described in claim 1, wherein said force exerting means comprises a hydraulic cylinder positioned vertically in axial alignment with said clevis rod extending above said compression plate, connecting means for connecting the end of the actuating rod of said hydraulic cylinder and the end of said clevis rod for transmitting upward force applied by said actuating rod to said clevis rod and to said jaw members, and bracket means for mounting said hydraulic cylinder on said compression plate for supporting said hydraulic cylinder in a vertical position above said housing.

12. The clamp as described in claim 1, wherein said lower portion of each of said jaw members has a radiused configuration for mating with a subsea tubular pipe member, and the inner surface of each of said radiused jaw members has mounted thereon a plurality of projecting hardened steel teeth for engaging said pipe member to make electrical continuity therewith.

13. The clamp as described in claim 1, wherein each of said jaw members comprises an upper jaw section substantially all of which is disposed within said housing, the upper ends of which are adapted for pivotal mating engagement and permitting limited movement therebetween, the lower ends of which project below the bottom of said housing, a lower jaw section the upper ends of which are removably attachable to the lower projecting ends of said upper jaw sections and having a lower portion thereof adapted for engaging selected subsea members, and attaching means for removably attaching said lower jaw section to said upper jaw section.

14. The clamp as described in claim 13, wherein said attaching means comprises tongue and groove mating ends of said upper and lower jaw sections having a plurality of registering transverse apertures therethrough, a plurality of pins each disposed transversely through one of said registering apertures in said tongue and groove mating ends for fastening said lower jaw sections to said upper jaw sections, and retaining means for retaining said pins in said transverse apertures.

15. The clamp as described in claim 14, wherein each of said lower jaw sections has a radiused configuration.

16. The clamp as described in claim 14, wherein said lower jaw sections comprise an elongated structural member the upper end of which is adapted for removable attachment to the projecting end of said upper jaw sections, a pair of plates one each of which is attached to the lower end of each of said elongated structural members in an opposing relationship, and a plurality of projecting teeth fixed to the face of each of said plates in an opposing interlocking pattern.

17. The trigger means as described in claim 1, wherein said trigger member is pivotally attached to said latch member adjacent said other end carrying said vertical slot, and wherein said trigger member when engaging the pipe exerts an upward force on said slotted end of said latch member for pivoting said latch member slotted end upwardly out of engagement with said other jaw stop pin.

18. A self-actuating clamp for attachment to a member disposed in a subsea environment, comprising a housing, including a pair of spaced side members, each of said side members having disposed therein a pair of horizontally spaced angled slots, the pair of horizontally spaced slots disposed in one side member registering with the pair of horizontally spaced slots disposed in the other of said side members for forming two pairs of registered horizontally spaced-apart elongated angled slots, each of said pair of registered slots slanting inwardly and upwardly toward the top edges of said side members, a compression plate mounted transversely to the top edges of said pair of side members and having an aperture disposed centrally therethrough, and at least one external accessary mounting plate attached transversely to side pair of side members, a pair of opposed elongated jaw members the upper portions of which are disposed within said housing and between said pair of spaced side members and below said compression plate, the upper ends of said jaw members adapted for pivotal mating engagement for permitting limited pivotal movement therebetween, the lower portions of said jaw members projecting below said housing side members and having mating configurations adapted for clamping engagement with the subsea member, a pivot pin transversely disposed through said upper mating ends of said pair of jaw members for supporting said jaw members in an opposed relationship and permitting pivotal movement therebetween, a pair of stop pins one of which is disposed transversely through each of said jaw members and projects through one of said pair of registered horizontally spaced-apart elongated angled slots and each of said side members, an inverted U-shaped clevis disposed over said mating ends of the pair of jaw members and engaging the opposite ends of said pivot pin, an elongated clevis rod fixed to said inverted U-shaped clevis and projecting vertically through said aperture in said compression plate, trigger means, comprising an elongated latch member having a transverse aperture in one end adapted for pivotal engagement with the end of one of said jaw stop pins projecting beyond said one housing side member, the other end of said latch member having a downwardly opening vertical slot disposed therein for engaging the end of the other one of said pins projecting beyond said one housing side member when said jaw members are in an open position, and a trigger member attached to said latch member and projecting downwardly below said housing for physically contacting the subsea member when the subsea member is properly positioned between said spaced-apart jaw members, said trigger member engaging the subsea member for exerting an upward force on said latch member for pivoting said latch member slotted end upwardly out of engagement with said other jaw stop pin, and spring means disposed within said housting and mounted thereon and cooperating with said jaw members for exerting closing forces thereagainst for biasing said projecting portions of said jaw members toward a closed position in clamping engagement with the subsea member.

19. The clamp as described in claim 18, where each of said housing side members has an elongated slot disposed therein along its vertical center line, and wherein the shoulders of said U-shaped clevis project into said slots for guiding movement of said clevis and pivot pin in a vertical direction.

20. The clamp as described in claim 18, wherein said spring means comprises transverse structural means disposed between said housing side members and adjacent said upper ends of said mating jaw members, and a pair of leaf springs assemblies disposed between said housing side members, each of said leaf spring assemblies positioned generally longitudinally adjacent said upper portion of one of said jaw members and having a lower end in engaging contact with the outer edge thereof, the upper portion of said leaf spring assemblies engaging said housing transverse structural means for inducing compressive forces in each of said leaf spring assemblies translated through said lower ends thereof to said jaw members for biasing said jaw members inwardly to a clamped position.

21. The clamp as described in claim 18, further including locking means mounted on said housing compression plate and cooperating with said projecting clevis rod for applying a lifting force on said clevis rod and the upper ends of said mating jaw members and exerting additional clamping forces on said jaw members engaging the subsea member and for locking said jaw members with respect thereto.

22. The clamp as described in claim 21, wherein said locking means comprises lifting means cooperating with said clevis rod and said housing compression plate for vertically lifting said clevis and supported pivot pin and mating ends of said jaw members toward said compression plate and exerting a predetermined force therebetween, said jaw member stop pins engaging the upper sides of each of said pair of registered angled slots for camming said stop pins upwardly and inwardly until a stopping point is reached, said stopping points acting as lever fulcrum points to transfer said spring means forces to said jaw members, and means for locking said jaw members with respect to said subsea member.

23. The clamp as described in claim 22, wherein said clevis rod is threaded, and wherein said lifting means comprises a nut threadably engaging the threaded end of said clevis rod projecting above said compression plate for translating rotating motion of said nut into vertical movement of said rod and applying a lifting force to said rod.

24. The clamp as described in claim 23, wherein said means for locking said jaw members comprises said nut cooperating with said threaded clevis rod, a plurality of Belleville washers disposed between said nut and said compression plate, and the cooperation of said jaw member stop pins engaging said upper sides of said pair of registered angled slots for preventing movement of said jaw members with respect to each other and with respect to said housing.

25. The clamp as described in claim 21, wherein said locking means comprises a hydraulic cylinder positioned vertically in axial alignment with said clevis rod extending above said compression plate, connecting means for connecting the end of the actuating rod of said hydraulic cylinder and the end of said clevis rod for transmitting upward force applied by said actuating rod to said clevis rod and to said jaw members, bracket means for mounting said hydraulic cylinder on said compression plate for supporting said hydraulic cylinder in a vertical position above said housing, said hydraulic cylinder cooperating with said clevis rod and said housing compression plate for applying a vertical lifting force to said clevis and supported pivot pin and mating ends of said jaw members toward same compression plate and exerting forces therebetween, said jaw member stop pins engaging the upper sides of each of said pair of registered angled slots for camming said stop pins upwardly and inwardly until a stopping point is reached, said stopping points acting as lever fulcrum points to transfer said force to said jaw members, said jaw member stop pins cooperatively engaging said upper sides of said pair of registered angled slots at said stopping points for preventing movement of said jaw members with respect to each other and with respect to said housing.

26. The clamp as described in claim 18, further including a flexible metal cable fixed to one of the projecting ends of each of said jaw member stop pins and one of said housing side plates to insure electrical continuity therebetween.

27. The clamp as described in claim 18, wherein said lower portion of each of said jaw members has a radiused configuration for mating with a subsea tubular pipe member, and the inner surface of each of said radiused jaw members has mounted thereon a plurality of projecting hardened steel teeth for engaging said pipe member to make electrical continuity therewith.

28. The clamp as described in claim 18, wherein each of said jaw members comprises an upper jaw section substantially all of which is disposed within said housing, the upper ends of which are adapted for pivotal mating engagement and permitting limited movement therebetween, the lower ends of which project below the bottom of said housing, a lower jaw section the upper ends of which are removably attachable to the lower projecting ends of said upper jaw sections and having a lower portion thereof adopted for engaging selected subsea members, and attaching means for removably attaching said lower jaw section to said upper jaw section.

29. The clamp as described in claim 28, wherein said attaching means comprises tongue and groove mating ends of said upper and lower jaw sections having a plurality of registering transverse apertures therethrough, a plurality of pins each disposed transversely through one of said registering apertures in said tongue and groove mating ends for fastening said lower jaw sections to said upper jaw sections, and retaining means for retaining said pins in said transverse apertures.

30. The clamp as described in claim 29, wherein said lower jaw section has a radiused configuration.

31. The clamp as described in claim 29, wherein said lower jaw sections comprise an elongated structural member the upper end of which is adapted for removable attachment to the projecting end of said upper jaw sections, a pair of plates one each of which is attached to the lower end of each of said elongated structural members in an opposing relationship, and a plurality of projecting teeth fixed to the face of each of said plates in an opposing interlocking pattern.

32. A self-actuating clamp for attachment to a member disposed in a subsea environment, comprising a housing, including a pair of spaced side members, each or said side members having disposed therein a pair of horizontally spaced angled slots, the pair of horizontally spaced slots disposed in one side member registering with the pair of horizontally spaced slots disposed in the other of said side members for forming two pairs of registered horizontally spaced-apart elongated angled slots, each of said pair of registered slots slanting inwardly and upwardly toward the top edges of said side members, a compression plate mounted transversely to the top edges of said pair of side members and having an aperture disposed centrally therethrough, and at least one external accessary mounting plate attached transversely to said pair of side members, a pair of opposed elongated jaw members the upper portions of which are disposed within said housing and between said pair of spaced side members and below said compression plate, the upper ends of said jaw members adapted for pivotal mating engagement for permitting limited pivotal movement therebetween, the lower portions of said jaw members projecting below said housing side members and having mating configurations adapted for clamping engagement with the subsea member, a pivot pin transversely disposed through said upper mating ends of said pair of jaw members for supporting said jaw members in an opposed relationship and permitting pivotal movement therebetween, a pair of stop pins one of which is disposed tranversely through each of said jaw members and projects through one of said pair of registered horizontally space-apart elongated angled slots and each of said side members, an inverted U-shaped clevis including an aperture disposed over said mating ends of the pair of jaw members and engaging the opposite ends of said pivot pin within the aperture of said clevis, an elongated clevis rod fixed to said inverted U-shaped clevis and projecting vertically through said aperture in said compression plate, force exerting means mounted on said housing and cooperating with said projecting clevis rod for applying sufficient downward forces on said clevis rod and the upper ends of said mating jaw members for maintaining saw jaw members in an open position, said force exerting means further cooperating with said compression plate and adapted for applying sufficient lifting forces on said clevis rod and the upper ends of said mating jaw members for selectively closing said jaw members to engage the subsea member.

33. The clamp as described in claim 32, further including locking means mounted on said housing compression plate and cooperating with said projecting clevis rod for applying a lifting force on said clevis rod and the upper ends of said mating jaw members and exerting additional clamping forces on said jaw members engaging the subsea member and for locking said jaw members with respect thereto.

34. The clamp as described in claim 33, wherein said force exerting means comprises a double-acting hydraulic cylinder positioned vertically in axial alignment with said clevis rod extending above said compression plate, bracket means for mounting said hydraulic cylinder on said compression plate for supporting said hydraulic cylinder in a position above said housing, said hydraulic cylinder actuating rod connected to said extending end of the clevis rod for forcing said clevis rod downwardly for maintaining said jaw members into an open position over the subsea member and forcing said clevis rod upwardly for closing said jaw members to clamping engagement with the subsea member.

35. The clamp as described in claim 34, wherein said locking means comprises said hydraulic cylinder cooperating with said clevis rod and said housing compression plate for applying a vertical lifting force to said clevis and supported pivot pin and mating ends of said jaw members toward said compression plate and exerting forces therebetween, said jaw member stop pins engaging the upper sides of each of said pair of registered angled slots for camming said stop pins upwardly and inwardly until a stopping point is reached, said stopping points acting as lever fulcrum points to transfer said force to said jaw members, said jaw member stop pins cooperatively engaging said upper sides of said pair of registered angled slots at said stopping points for preventing movement of said jaw members with respect to each other and with respect to said housing.

36. A self-actuating clamp for attachment to a pipe disposed in a subsea environment, comprising a housing, including a pair of spaced side members, each or said side members having disposed therein a pair of horizontally spaced angled slots, the pair of horizontally spaced slots disposed in one side member registering with the pair of horizontally spaced slots disposed in the other of said side members for forming two pairs of registered horizontally spaced-apart elongated angled slots, each of said pair of registered slots slanting inwardly and upwardly toward the top edges of said side members, a compression plate mounted transversely to the top edges of said pair of side members and having an aperature disposed centrally therethrough, and at least one external accessary mounting plate plate attached transversely to said pair of side members, a pair of opposed elongated jaw members the upper portions of which are disposed within said housing and between said pair of spaced side members and below said compression plate, the upper ends of said jaw members adapted for pivotal mating engagement for permitting limited pivotal movement therebetween, the lower portions of said jaw members projecting below said housing side members and having radiused configurations corresponding to the outer surface configuration of the pipe, a pivot pin transversely disposed through said upper mating ends of said pair of jaw members for supporting said jaw members in an opposed relationship and permitting pivotal movement therebetween, a pair of stop pins one of which is disposed transversely through each of said jaw members and projects through one of said pair of registered horizontally spaced-apart elongated angled slots and each of said side members, an inverted U-shaped clevis disposed over said mating ends of the pair of jaw members and engaging the opposite ends of said pivot pin, an elongated clevis rod fixed to said inverted U-shaped clevis and projecting vertically through said aperture in said compression plate, the extending end of said clevis rod having threads disposed thereon, at least one spherical roller bearing mounted on the lower side of said housing for rotationally engaging the pipe and preventing the pipe from engaging said housing, actuating means for maintaining said jaw members in an open position while the clamp is positioned over the pipe and releasing said jaw members to permit movement thereof into engagement with the pipe, force exerting means cooperating with said jaw means for exerting sufficient force on each of said jaw members for closing said jaw members into engagement with the pipe, a plurality of spherical roller bearings mounted in a spaced pattern on the inside of the radiused lower portion of each of said jaw members for rotationally engaging the pipe outer surface and urging the pipe into a centered position with respect to said housing and opposing jaw members, said bearings permitting the clamp to rotate with respect to the pipe when said jaw members have been closed by said force exerting means, a pair of shock absorbing cylinders, one each of which is disposed adjacent each of said housing side members and between said jaw member stop pins, means for pivotally attaching said pair of shock absorbing cylinders to each end of said jaw member stop pins, and a lock nut for engaging said clevis rod threaded end projecting above said housing compression plate for translating rotating motion of said lock nut into vertical movement of said clevis rod, and after contact with said housing compression plate applying an upward force between said clevis rod and said housing for holding said jaw members in a closed engaging position around the pipe.

37. The clamp as described in claim 36, wherein said actuating means comprises trigger means cooperating with said jaw members for holding said jaw members in an open position and in response to contact with the pipe releasing said jaw members for engaging contact with the pipe.

38. The clamp as described in claim 37, wherein said trigger means comprises an elongated latch member having a transverse aperture in one end adapted for pivotal engagement with the end of one of said jaw stop pins projecting beyond said one housing side member, the other end of said latch member having a downwardly opening vertical slot disposed therein for engaging the end of the other one of said pins projecting beyond said one housing side member when said jaw members are in an open position, and a trigger member attached to said latch member and projecting downwardly below said housing for physically contacting the pipe when the pipe is properly positioned between said spaced-apart jaw members, said trigger member engaging the pipe for exerting an upward force on said latch member for pivoting said latch member slotted end upwardly out of engagement with said other jaw stop pin.

39. The trigger means as described in claim 38, wherein said trigger member is pivotally attached to said latch member adjacent said other end carrying said vertical slot, and wherein said trigger member when engaging the pipe exerts an upward force on said slotted end of said latch member for pivoting said latch member slotted end upwardly out of engagement with said other jaw stop pin.

40. The claim as described in claim 36, wherein said force exerting means comprises spring means disposed within said housing between said side members and cooperating with said jaws for exerting closing forces thereagainst to close said jaw members about the pipe.

41. The clamp as described in claim 40, wherein said spring means comprises transverse structural means disposed between said housing side members and adjacent said upper ends of said mating jaw members, and a pair of leaf spring assemblies disposed between said housing side members, each of said leaf spring assemblies positioned generally longitudinally adjacent said upper portion of one of said jaw members and having a lower end in engaging contact with the outer edge thereof, the upper portion of said leaf spring assemblies engaging said housing transverse structural means for inducing compressive forces in each of said leaf spring assemblies translated through said lower ends thereof to said jaw members for biasing said jaw members inwardly to a closed position.

* * * * *